US010626685B2

(12) United States Patent
Pitcher

(10) Patent No.: US 10,626,685 B2
(45) Date of Patent: Apr. 21, 2020

(54) ROD ROTATION APPARATUS

(71) Applicant: DRILL RIG SPARES PTY LTD, Wacol, Queensland (AU)

(72) Inventor: Ian Pitcher, Fig Tree Pocket (AU)

(73) Assignee: DRILL RIG SPARES PTY LTD, Wacol, Queensland (AU)

( * ) Notice: Subject to any disclaimer, the term of this patent is extended or adjusted under 35 U.S.C. 154(b) by 123 days.

(21) Appl. No.: 15/307,202

(22) PCT Filed: Apr. 28, 2015

(86) PCT No.: PCT/AU2015/000252
§ 371 (c)(1),
(2) Date: Oct. 27, 2016

(87) PCT Pub. No.: WO2015/164911
PCT Pub. Date: Nov. 5, 2015

(65) Prior Publication Data

US 2017/0044849 A1 Feb. 16, 2017

(30) Foreign Application Priority Data

Apr. 28, 2014 (AU) ..... 2014901529

(51) Int. Cl.

| | |
|---|---|
| ***E21B 19/08*** | (2006.01) |
| ***E21B 7/02*** | (2006.01) |
| ***E21B 3/04*** | (2006.01) |
| ***E21B 15/00*** | (2006.01) |

(52) U.S. Cl.
CPC ..... *E21B 19/08* (2013.01); *E21B 3/045* (2013.01); *E21B 7/021* (2013.01); *E21B 15/00* (2013.01)

(58) Field of Classification Search
CPC ..... E21B 19/08; E21B 19/008; E21B 3/04; E21B 3/045; E21B 7/02; E21B 7/021; E21B 7/028; E21B 15/00
See application file for complete search history.

(56) References Cited

U.S. PATENT DOCUMENTS

| | | | | |
|---|---|---|---|---|
| 2,080,804 A | | 5/1937 | Brantly | |
| 2,314,323 A | | 3/1943 | Alexander et al. | |
| 2,594,847 A | * | 4/1952 | Bates | E21B 15/00 173/151 |

(Continued)

FOREIGN PATENT DOCUMENTS

| | | |
|---|---|---|
| GB | 399468 | 10/1933 |
| WO | WO 2006/026080 A2 | 3/2006 |

OTHER PUBLICATIONS

International Search Report from the Australian Patent Office for International Application No. PCT/AU2015/000252 dated Sep. 1, 2015.

(Continued)

*Primary Examiner* — Michael R Wills, III
(74) *Attorney, Agent, or Firm* — Finnegan, Henderson, Farabow, Garrett & Dunner, LLP

(57) ABSTRACT

An apparatus for rotating a tube or rod is provided. The tube or rod is supported from a mast of a rig and for insertion into a well. The apparatus includes a rotation member for rotating the tube or rod. The rotation member is mounted on the well such that in use, the tube or rod is fed into the rotation member, from above the rotation member, and into the well.

16 Claims, 11 Drawing Sheets

(56) References Cited

U.S. PATENT DOCUMENTS 2,617,500 A 11/1952 Cardwell et al.
4,020,909 A * 5/1977 Airaudo ..... E21B 7/021 173/147
4,021,978 A * 5/1977 Busse ..... E21B 15/00 403/13
4,290,495 A * 9/1981 Elliston ..... E21B 7/02 166/77.4
4,326,602 A * 4/1982 Bryant ..... E04G 3/30 175/85
6,158,516 A * 12/2000 Smith ..... E21B 3/045 166/385
6,412,554 B1 * 7/2002 Allen ..... E21B 3/04 166/379
6,412,576 B1 * 7/2002 Meiners ..... E21B 15/00 175/170
6,681,894 B1 1/2004 Fanguy
8,280,636 B2 10/2012 Newman
8,915,310 B2 * 12/2014 Flusche ..... E21B 7/023 175/162
2003/0075023 A1 * 4/2003 Robichaux ..... E21B 19/07 81/57.37
2011/0036638 A1 2/2011 Sokol et al.
2014/0124218 A1 * 5/2014 Pilgrim ..... E21B 44/02 166/380
2014/0138080 A1 * 5/2014 Yorga ..... E21B 19/14 166/77.51
2015/0240562 A1 * 8/2015 Ferrari ..... E21B 15/00 52/118

OTHER PUBLICATIONS

International Preliminary Report on Patentability from the Australian Patent Office for International Application No. PCT/AU2015/000252 dated Sep. 14, 2016.
European Search Report dated Apr. 12, 2017.

* cited by examiner

ROD ROTATION APPARATUS

CROSS-REFERENCE TO RELATED APPLICATIONS

This application is a national phase application of International Application No. PCT/AU2015/000252, filed Apr. 28, 2015, and claims the priority of Australian Application No. 2014901529, filed Apr. 28, 2014, the content of both of which is incorporated herein by reference.

TECHNICAL FIELD

The present disclosure relates to the completion, repair and maintenance of wells such as oil & gas wells and coal seam gas wells.

BACKGROUND

A number of specialised pieces of equipment are used in the construction and operation of wells. These specialised pieces of equipment include various types of rigs. A drill rig is used to drill the well. A work-over or intervention rig is used to rotate rods into the well to complete the well. A flushby rig is used to flush debris from the well.

During maintenance and repair works, a flushby rig may be used to flush the well. When flushing has failed to re-establish production from a well and the well needs intervention to bring the well back into production, the practice is to remove the flushby rig and set up a larger workover/intervention rig. The workover/intervention rig performs work and drills with the rods. After the workover/intervention rig has completed its work, it is removed and the flushby rig returns to the well to flush out the well.

The process of exchanging rigs uses considerable time. Currently, intervention rigs can take up to 6 hours to setup and up to another 4 to 5 hours to take down.

SUMMARY

The present disclosure provides in a first aspect an apparatus for rotating a tube or rod, the tube or rod being supported from a mast of a rig and for insertion into a well, the apparatus including a rotation member for rotating the tube or rod, wherein the rotation member is mounted on the well such that in use, the tube or rod is fed into the rotation member, from above the rotation member, and into the well.

The tube or rod can be fed into the well to clean out the well, to drill into the well for cleaning, or to drill into the well for extending it.

In an embodiment the rotation member is associated with the well itself rather than being provided on any other structure independent of the well. By "associated with the well" it is meant that the rotation member can be attached to one of the components of the well at the surface. The rotation member can be mounted to a component of the well. The well comprises a number of components at the surface including a blowout preventer (BOP). A blowout preventer is a large, specialised valve or similar mechanical device, usually installed to at least seal, control and/or monitor wells such as oil and gas wells. Blowout preventers were developed to cope with extreme erratic pressures and uncontrolled flow (formation kick) emanating from a well reservoir during drilling. Another component of a well is a stuffing box. The stuffing box is used to seal a rotating or reciprocating shaft against a fluid. Notwithstanding the function of any well component, in the first aspect of the present disclosure, the rotation member is mounted on the well or to the well by any component which can carry its weight and orient it such that a tube or rod can be fed into it from above and into the well. The mounting can be by bolting the rotation member to the component.

In one embodiment, the rotation member is accessible by an access platform. The access platform can be U-Shaped so as to be located substantially around the rotation member when in use. The access platform can be attached to a rig. The access platform can be movably attached to the rig. The access platform can be moved from an inoperable position to an operable position. In the operable position, the access platform provides access to the rotation member. In the inoperable position, the access platform is stowed possibly for transport. The rotation member can also be attached to the access platform to absorb any torsional forces. The rotation member can be attached to the platform by a series of bolts which can engage into torsional cylinders disposed in the rails which form the platform.

Thus, according to the disclosure in a second aspect there is provided a system for rotating a tube or rod, the system comprising a rig and an apparatus, the tube or rod being supported from a mast of the rig and for insertion into a well, the apparatus comprising:

- a rotation member for rotating the tube or rod, wherein the rotation member is mounted on the well;
- an access platform movably attached to the rig for providing access to the rotation member over the well;
- wherein, in use, the tube or rod is fed into the rotation member by the rig, from above the rotation member, and into the well.

In an alternative embodiment, the access platform can be independent of a rig and can be provided in the form of a free-standing platform. In one embodiment, therefore, the rotation member and the access platform are structurally independent from the rig. Thus, the present disclosure provides in a third aspect an apparatus for rotating a tube or rod, the tube or rod being supported from a mast of a rig and for insertion into a well, the apparatus comprising:

- a rotation member for rotating the tube or rod, wherein the rotation member is mounted on the well;
- an access platform for providing access to the rotation member over the well,
- wherein the rotation member is structurally independent from the rig. Optionally, the access platform is also structurally independent of the rig.

Also described is an arrangement in which the rotation member is structurally independent from the rig, and is supported by a support platform over the well rather than by the well itself. The support can thus become a component of the well. Thus, the present disclosure provides in a fourth aspect an apparatus for rotating a tube or rod, the tube or rod being supported from a mast of a rig and for insertion into a well, the apparatus comprising:

- a rotation member for rotating the tube or rod;
- a support for supporting the rotation member over the well,
- wherein the support and rotation member are structurally independent from the rig.

When the support is structurally independent from the rig, the present disclosure also provides in a fifth aspect an apparatus for rotating a tube or rod, the tube or rod being supported from a mast of a rig and for insertion into a well, the apparatus comprising:

- a rotation member for rotating the tube or rod positioned, in use, above a well; and a support positioned, in use, on the ground beneath a crown of the mast for supporting the rotation member from below.

All of the description herein relates to the first, second, third, fourth or fifth aspects of the disclosure, unless the context makes clear otherwise.

The rotation member provides a large gear driven by hydraulic motors. The rotation member includes a chuck which engages with the gear. The arrangement for rotation may be held between a pair of guide columns. There may be more than two guide columns. The guide columns may be positioned at opposite sides of the rotation member. Each guide column may comprise a substantially C-shaped track along which the rotation member travels. Each guide column may include a lift member for lifting the rotation member. Each lift member may comprise a cylinder. All together the components of the rotation member can also be referred to as a drill module.

The rotation member may travels up and down along a stroke of the rotation member. The rotation member may advance, over the length of the stroke, downwardly with the tube or rod towards the well before resetting back to a top of the stroke. When at the closest point to the well, the rotation member may be at a bottom of the stroke. The length of the stroke may be divisible into the length of the tube or rod. The length of the stroke may be one quarter of the length of the tube or rod. The length of the stroke may be between 900 mm and 1200 mm. The length of the stroke may be 1200 mm. The length of the stroke may be 1500 mm.

The support may comprise an access platform. The access platform may comprise a deck. The platform may be substantially rectangular in shape. The platform may include a hole through which the rod passes between the rotation member and well. The distance from the centre of the hole to a front side of the platform may be 1000 mm. The distance from the centre of the hole to a side of the platform may be 1800 mm. The distance from the centre of the hole to a rear side of the platform may be 1800 mm. The platform may be U-shaped, with the well received (and rotation member mounted thereon), in use, in between the arms of the 'U'.

The platform may be mounted to the rig. The platform can be mounted to the side of the rig. The platform can be mounted to the rear of the rig. The platform can have dimensions suitable to allow it to be a fit beneath the mast of a flushby rig. The platform may be articulated to allow movement relative to the rig. The platform may be mounted by a series of hydraulically powered hinges which allow for automatic movement. The movement may be between an inoperable position and an operable position. The movement may be effected by a hydraulic arm. In the inoperable position, the platform can be stowed and the rig can move with the platform being substantially flush to the rig body. The platform can be cantilevered. The platform can be lowered to a substantially horizontal operable position. The platform can be lowered manually or automatically. In the operable position, the platform can be supported at one end by the rig and at the other end by one or more legs or columns which can depend from the platform to the ground. The legs may comprise a driven extensible member for raising or lowering the platform. The legs may comprise a structural member for fixing the height of the platform once raised. The driven extensible member may comprise a hydraulic cylinder. The structural member may comprise a threaded support or threaded column. The platform may be structurally independent of the rig. In this embodiment, the platform may be supported substantially horizontally on the ground by a plurality of legs. The platform may be supported on 4 legs. The legs may be positioned at locations around the well. The legs may comprise a driven extensible member for raising the platform. The legs may comprise a structural member for fixing the height of the platform once raised. The driven extensible member may comprise a hydraulic cylinder. The structural member may comprise a threaded support or threaded column.

When the apparatus is structurally independent of the rig, the apparatus may further comprise engaging means for engaging the rig to prevent rotation of the apparatus when in use. The engaging means may comprise one or more extensible members for extending between the apparatus and rig. The extensible members may each comprise a ram. A distal end of each ram may be keyed to engaged a corresponding key member on the rig. The distal end of each ram may be configured for engaging a support of an elevated work platform of the rig.

When the rotation member is mounted to the well, it may comprise means for preventing the rotation of itself in situ. It should be understood that there must be no rotation through the blowout preventer (BOP) so a means for preventing rotation of the rotation member may be required to meet relevant Standards. A means for preventing rotation may be a series of bolts which extend from the rotation member and are secured into the platform. The platform is heavy and unable to rotate.

The rotation member may be hydraulically and/or electronically connectable to the rig. The rotation member may be controllable from controls mounted on the rig. The controls of the rig may include a display panel. The display panel may have a first configuration showing controls of the rig when the rotation member is not hydraulically and electrically connected to the rig. The display panel may have a second configuration showing controls of the rotation member and related equipment of the rig, when the rotation member is hydraulically and electrically connected to the rig.

The rotation member may comprise a friction member for engaging an outer surface of the tube or rod. The friction member may be driven to rotate the tube or rod. The rotation member may comprise a chuck drive.

Tubes or rods inserted into the well may be retained within the well by the rotation member and the total weight of the apparatus. The weight force of the apparatus may be greater than the upward force applied on the tube or rod by fluid pressure in the well. For this purpose, the apparatus may weigh at least 5 tonnes. The apparatus may in fact weigh at least 6 tonnes.

The rotation member may provide a variable speed function for varying the rate at which the tube or rod is lowered. The variable speed function may slow the feed rate of the tube or rod when the weight of the tube or rod, as measured by the apparatus or rig, is less than a predetermined value. The rotation member may provide a fine feed function and a weight-controlled feed function for lowering the tube or rod at a faster and a slower speed respectively. The rate of feed of the tube or rod may be controlled by the apparatus. The rate of feed of the tube or rod may be controlled by the lift member of each guide column. The rate of feed of the tube or rod may be controlled by a winch of the rig. The rate of feed of the tube or rod may be controlled by a drawworks winch of the rig.

The fine feed function may feed the tube or rod into the well at a first speed. The weight-controlled feed function may feed the tube or rod into the well at a second speed lower than the first speed. The second speed may be a speed at which the weight of the tube or rod (or tube or rod string)

as measured by the apparatus or rig is a predetermined weight. The weight-controlled speed may be a variable speed at which the predetermined weight is maintained.

The apparatus or rig may measure a downward force of the tube or rod. When the downward force of the tube or rod, as measured by the apparatus or rig, is lower than a predetermined threshold, the rotation member may rise to at least partially withdraw the tube or rod from the well, and the weight-controlled feed function may then be used to lower the tube or rod at a slower speed. The rig or apparatus may be configured to automatically move from the fine feed function to the weight-controlled feed function.

The fine feed function may feed the tube or rod at a first set feed rate. The weight-controlled feed function may feed the tube or rod at a second set feed rate lower than the first set feed rate. The weight-controlled feed function may feed the tube or rod at a rate that maintains a minimum measurement for the weight of the tube or rod, or tube or rod string, as measured by the apparatus. The weight-controlled feed function may feed the tube or rod at a rate that maintains a minimum measurement for the weight of the tube or rod, or tube or rod string, as measured by the rig.

Using the fine feed rate and weight-controlled feed rate may enable the apparatus to control the rate of feed of the tube or rod at all times throughout lowering of the tube or rod.

The tubes or rods may be drawn from one or more catwalks mounted to the support/access platform. A catwalk may be located at a rear side of the apparatus. A catwalk may be positioned at one or both lateral sides of the apparatus—a 'lateral side' is taken to mean a side extending towards and away from the rig, in use. The tube or rod may be part of a tube or rod string.

The apparatus may further comprise retaining means provided on the support/access platform, for retaining the tube or rod string while a further tube or rod is attached thereto. The retaining means may comprise a foot clamp.

The present disclosure further provides a method for inserting a tube or rod into a well, comprising:

a. positioning a rig in the vicinity of the well;
b. positioning the apparatus according to any one of the aspects of the disclosure over the well;
c. lowering a tube or rod towards the well using the rig, and concurrently rotating the tube or rod using the rotation member of the apparatus.

In one embodiment, the step of positioning the apparatus over the well comprises the step of mounting a rotation member to the well. In an embodiment, the positioning step also includes moving an access platform optionally attached to a rig into an operable position. The method may also include attaching the rotation member to the platform to secure it against any torsional forces.

The present disclosure still further provides a method for controlling lowering of a tube or rod string into a well using a winch of a rig, comprising:

a. lowering the string at a first speed;
b. measuring a 'weight on hook' of the winch;
c. at least partially retracting the string when the measured 'weight on hook' indicates that the tube or rod string is exerting pressure on the well that exceeds a predetermined pressure; and
d. lowering the string at a second speed lower than the first speed.

The predetermined pressure may be based on a weight measurement of the rod or tube on the rig. A weight measurement may be indicative of a downward force, downward pressure or other measurement of force applied by the tube or rod to the apparatus. A weight measurement may be indicative of a downward force, downward pressure or other measurement of force applied by the tube or rod to the rig. The 'weight on hook' may be the weight of the tube or rod (or tube or rod string) minus the upward force applied by the well to the tube or rod (or tube or rod string). The predetermined pressure may be based on a weight measurement of the rod or tube on the apparatus. The 'weight on hook' may be a weight as measured at the apparatus or rig as the case may be, even though that measurement may heretofore be understood exclusively to mean a weight as measured on the hook of the rig.

The measuring step may be performed while at least the first lowering step is being performed.

The rig may be configured to automatically perform at least steps c and d.

The second speed may vary to maintain a particular measurement for the 'weight on hook'. The first speed may be a fixed speed. The second speed may be a fixed speed that is slower than the first speed.

Some embodiments of the present apparatus may enable a rig, such as a flushby rig, to remain in position at a well to perform well intervention work using the apparatus. Thus, such embodiments may avoid the need to use workover/intervention rigs where traditionally such a rig may have been used.

BRIEF DESCRIPTION OF THE DRAWINGS

Embodiments of an apparatus for rotating a rod will now be described by way of non-limiting example only, with reference to the accompanying drawings, in which.

DETAILED DESCRIPTION

Figure 1:
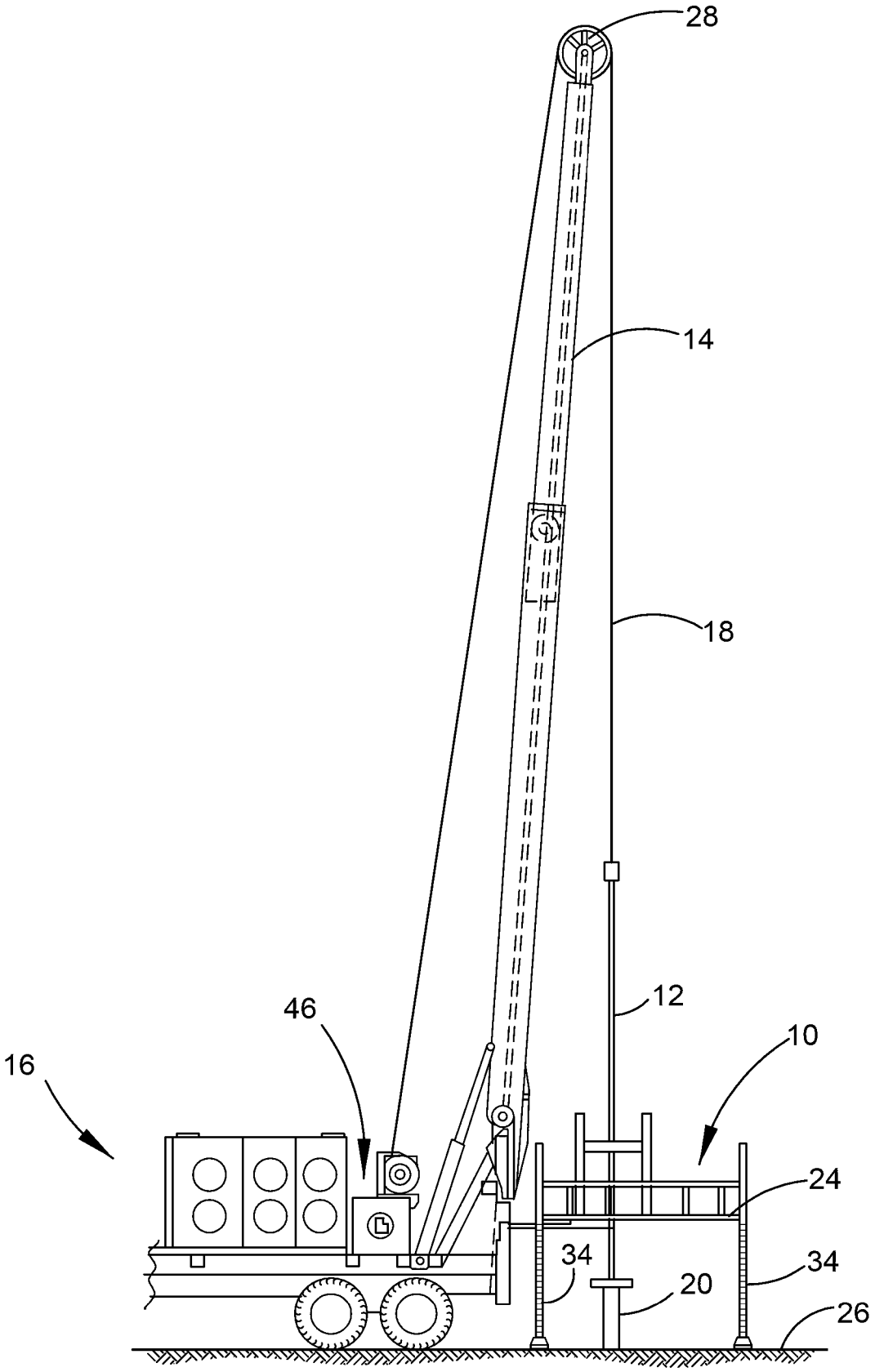
FIG. 1 shows an embodiment of a rig and an apparatus for rotating a rod in which the support is structurally independent of the rig.

FIG. 1 shows an apparatus 10 for rotating a rod 12. The rod 12 is supported from a mast 14 of a rig 16 by a line 18: in most cases the rod 12 will be supported from the draw-works of the rig 16, and thereby be supported from the mast 14. The rod 12 is insertable into a well 20. The rod 12 will typically form part of a string of rods 12, or a 'drill string'.

Figure 2:
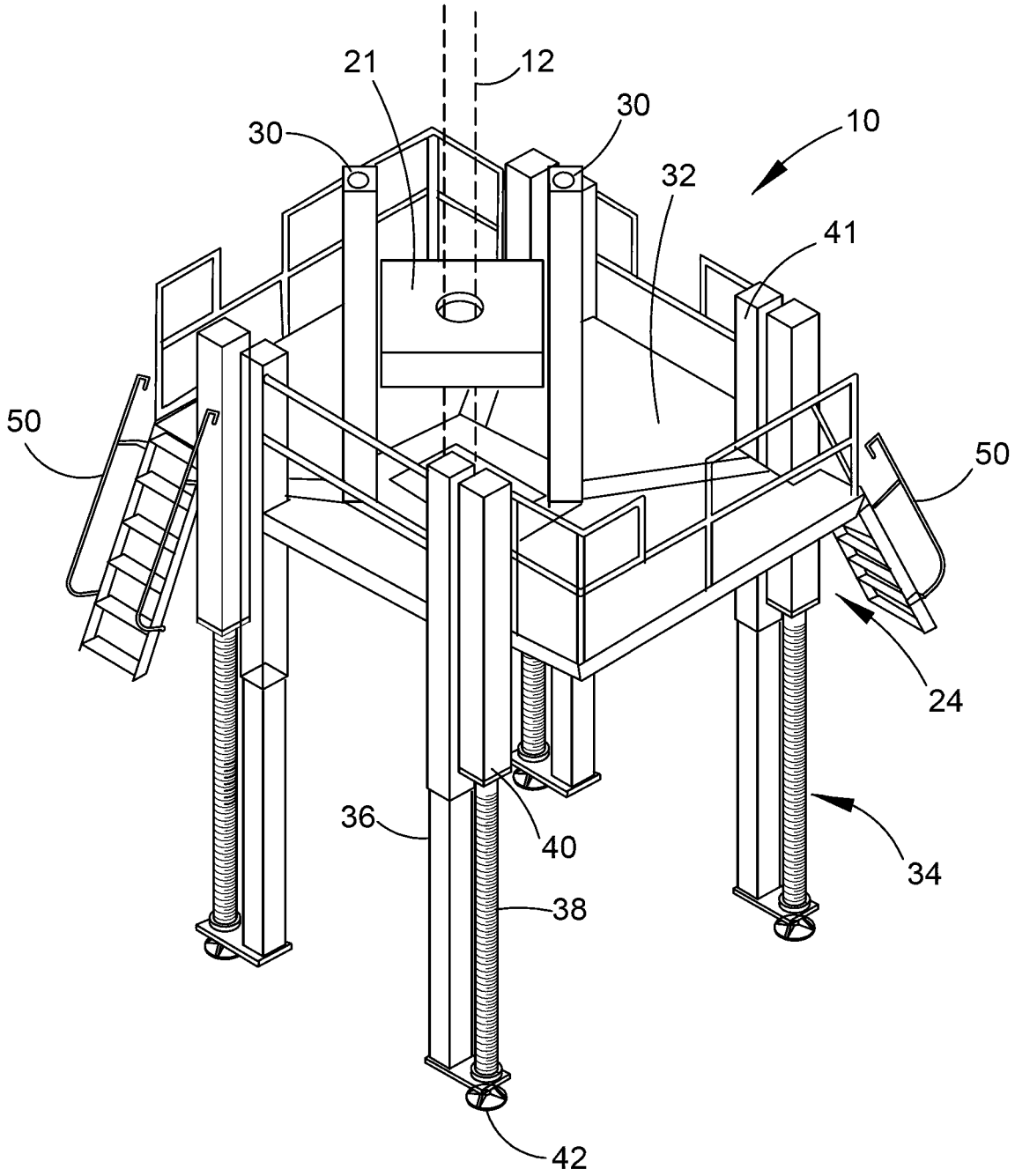
FIG. 2 is a side perspective view of the apparatus of FIG. 1.

As shown in FIG. 2, the apparatus 10 comprises a rotation member 21 which includes a chuck drive 22 (not shown in FIG. 2) for rotating the rod 12 (shown in broken lines), and a support, in the form of a raised access platform 24, for supporting the rotation member 21 over the well 20. An embodiment of the apparatus 100 in which the chuck drive 220 can be seen in detail is shown in FIGS. 6 to 9.

In the embodiment shown in at least FIG. 1, the platform 24 and rotation member 21 are structurally independent from the rig 16. The rig 16 can therefore be used to raise and lower rods 12 into and out of the well 20, while the apparatus 10 is used for rotation of those rods 12. In other words, the rig 16 is not responsible for rotating the rods 12. By structurally independent, it is meant that the platform and chuck drive are not supported by the rig, but it should be understood that any incidental or indirect connection (such as that provided to resist rotation of the apparatus 10 relative to the rig 16) can be provided without departing from the spirit of this embodiment. For example, there may be guard rails or chains extending between the platform and chuck drive and the rig to meet safety standards required at the drill site.

In the embodiment shown in FIGS. 1 to 3 the platform 24 is positioned on the ground 26 beneath the crown 28 of the mast 14 and supports the chuck drive 22 from below. As such, rods 12 can be fed into the chuck drive 22, from above the chuck drive 22, and down into the well 20.

Figure 5:
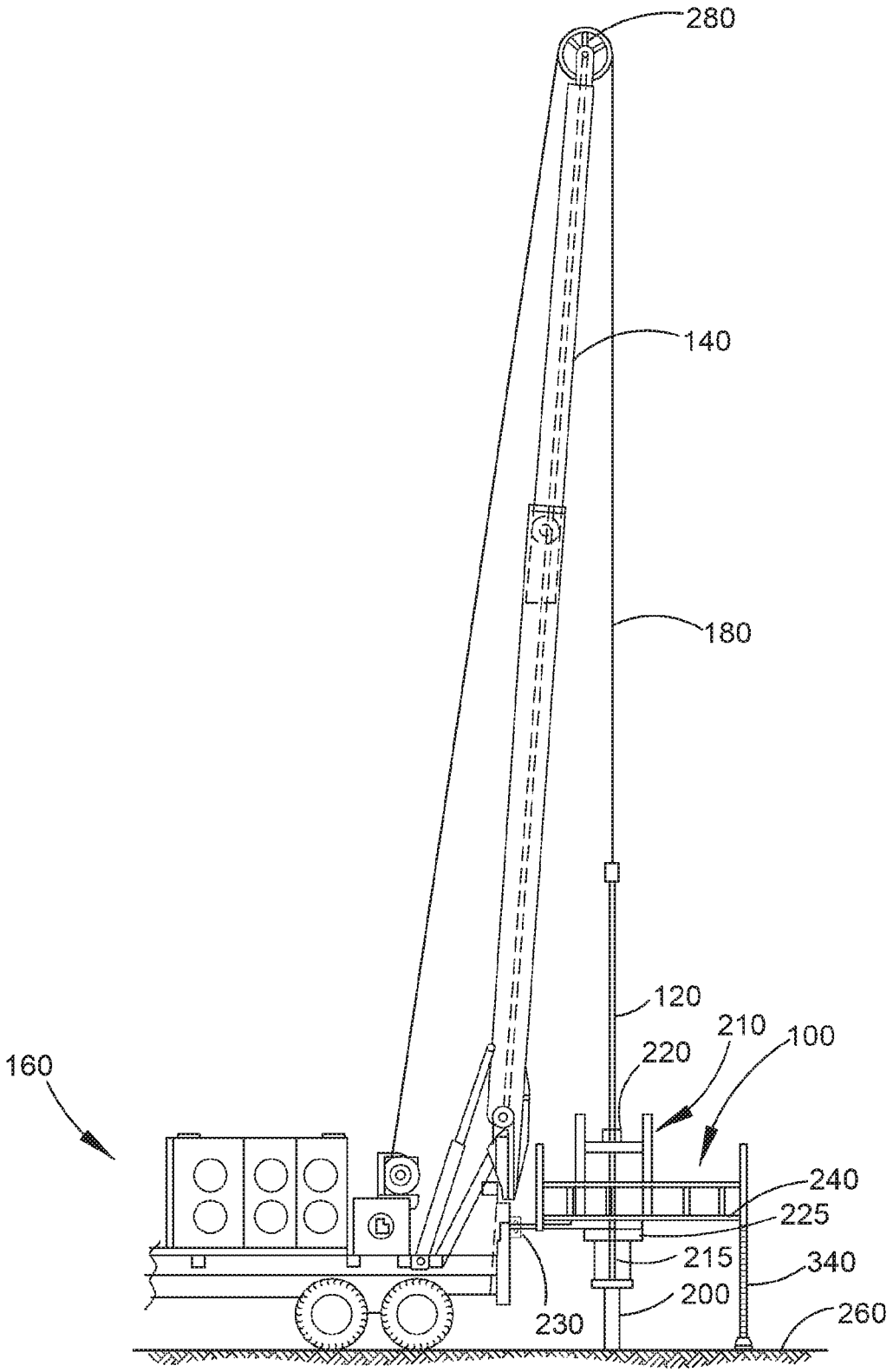
FIGS. 5 and 5A show an embodiment of a rig and an apparatus for rotating a rod in which the support/access platform is attached to the rig.
Figure 10:
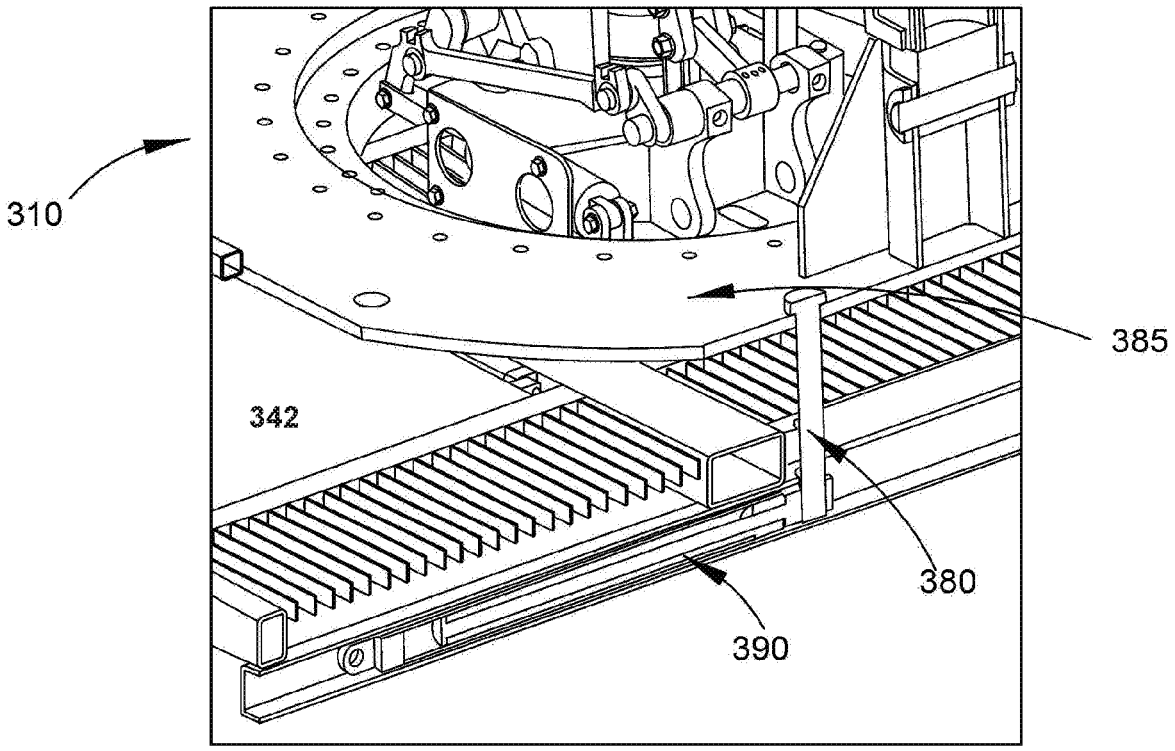
FIG. 10 is a perspective view of a cut away of the rotation member mounted to a platform.

As can be seen in FIG. 5, in some embodiments, access platform 240 is mounted to rig 160. The platform is coupled to the rig by connection 230. The connection 230 can be a hinge 230. This is more clearly seen in FIG. 6. The connections 230 are adapted to move about a rod attached to the rear of the rig 160 (not shown). The rig 160 can still be used to raise and lower rods 120 into and out of the well 200, while the apparatus 100 is used for rotation of those rods 120. Each rod 120 is supported from a mast 140 of a rig 160 by a line 180. The rod 120 is insertable into a well 200. In this embodiment, as in the above described, the rig 160 is not responsible for rotating the rods 120. The rotation member 210 is supported by well 200. The well includes BOP 215 and stuffing box 225. The rotation member can be bolted to stuffing box 225. In order to secure the rotation member 210 (the drill module) against any torsional forces, it can be further bolted to the platform support 240. This can be seen in FIG. 10. In FIG. 10, a cut away bolt 380 can be seen with a head part engaging with a base 385 of rotation member 310. The bolt is captured by torsion cylinder 390 which is embedded in platform 342. There can be any number of bolts 380 arranged around the periphery of base 385. Other means for attaching the rotation member 310 to the platform are within the scope of the invention.

To support the rotation member 21 in position, there can be two guide columns. Each guide column can be in the form of a substantially C-shaped track 30. A lift cylinder can be mounted in each track 30. In an alternative embodiment, shown in FIGS. 6 to 9, the rotation member 210 can be supported by columns 300 which are telescopically movable along posts 310. A lift cylinder can be mounted in association with each post and column to effect the movement. The lift cylinders lift opposite sides of the rotation member 210 supporting the chuck drive 220 in unison to the top of the stroke of the chuck drive 220. While the cylinders may also lower the chuck drive 220 towards the bottom of the stroke of the chuck drive 220, in use the chuck drive 220 will descend under the weight of the rods 120. The cylinders are therefore used to control the rate of descent of the chuck drive 220 and thereby the rate of descent of the rods 120. The chuck drive 220 can be driven by hydraulic drive motors 250. These motors 250 also prevent any unwanted rotation of the rotation member 210.

Description of the process in relation to FIGS. 5 to 9 also relates to the embodiment of FIGS. 1 to 4 (and visa versa) unless the context makes clear otherwise.

Figure 3:
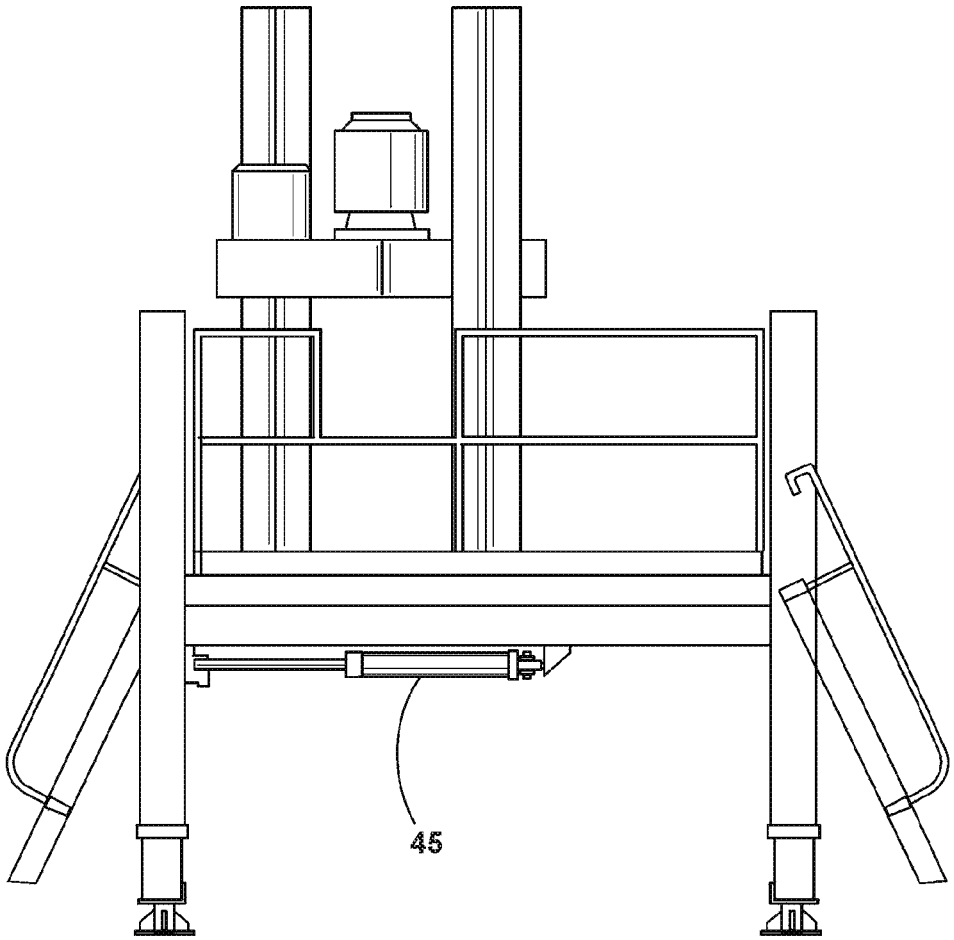
FIG. 3 is a side view of an alternative apparatus for rotating a rod, in which a drive for the rotating member is mounted at a top of the rotating member.
Figure 4:
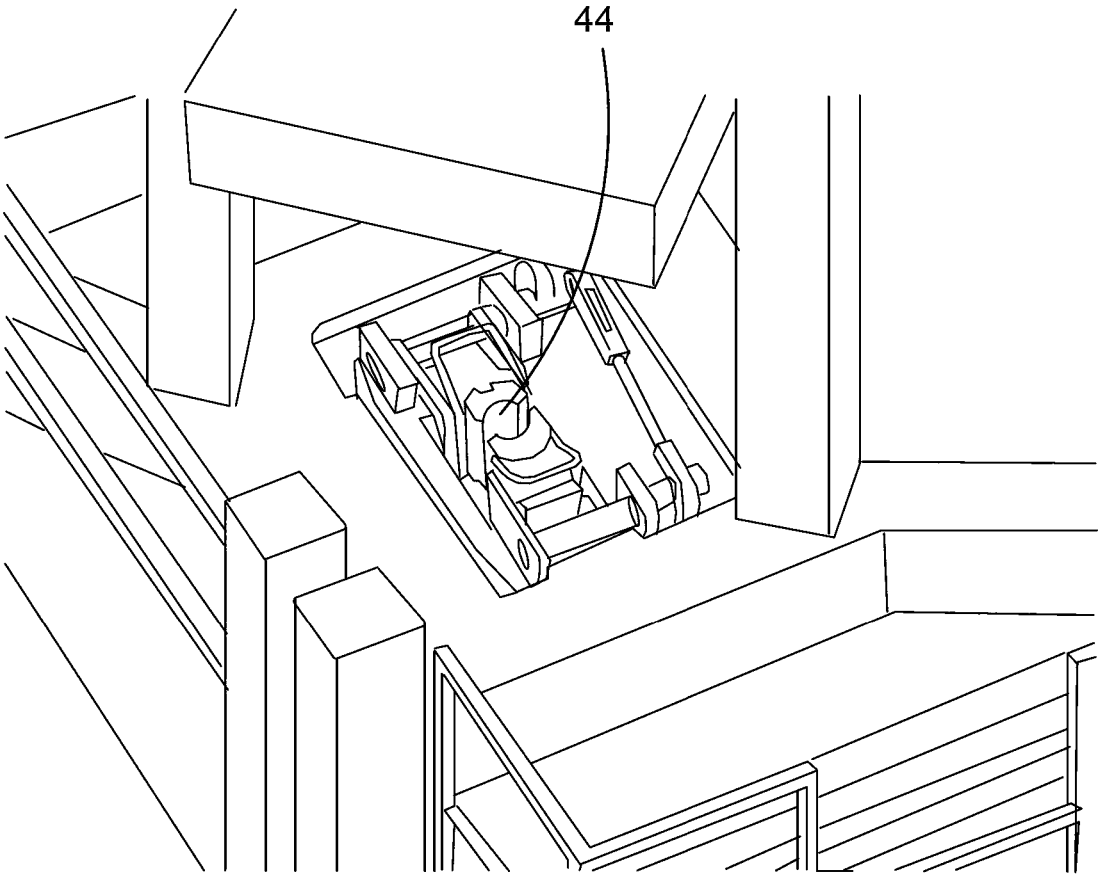
FIG. 4 is a close-up partial view of the deck of the apparatus of FIG. 1, showing a foot clamp for retaining a rod in position during movement of the rotating member.

In FIG. 3, the rotation member 21 is mounted in the tracks 30 on slides, bearings or any other appropriate mounting mechanism to enable the chuck drive 22 to be raised and lowered.

In FIGS. 1 to 3, the platform 24 comprises a deck 32 and a plurality of legs 34. The dimensions of the deck 32, and the platform 24 as a whole, are designed to fit within the standard distance required to fit the apparatus 10 beneath the mast 14 of a flushby rig such as rig 16. For example, the distance from the centreline of the chuck drive 22 (and thus the centreline of the well 20) to the edge of the apparatus closest to the rig 16 may be a maximum of 1000 mm, where such a rig 16 would typically be setup around 1200 mm to 1400 mm from the well.

The rotation member 21 can be mounted directed to the well 20. In this embodiment, the deck 32 as described can be arranged substantially around the rotation member for access. The deck 32 can be raised and lowered on legs 34 to adjust the height of the deck 32 for positioning above wells 20 of various heights. The legs 34 may be extensible such that the deck has a height of up to 3500 mm from the ground. For other wells, the height of the well 20 when the platform 24 is positioned over the well 20 may be 2500 mm, 3200 mm or 3700 mm, or any other height. Each leg 34 comprises a jack lift cylinder 36 and a threaded support 38. The threaded support 38 extends from a sleeve 40 down to a foot 42. The sleeve 40 is fixed in position relative to the deck 32. At the top of each jack lift cylinder 36 is an indicator 41 that indicates whether the leg 34 is in contact with the ground. The indicator 41 may also indicate whether the respective cylinder 36 is properly functioning. An inclinometer or other level sensor (not shown) is used to automatically control the legs 34 to level the deck 32. If, at any stage throughout use of the apparatus 10, the deck 32 moves out of level as determined by the level sensor, then the apparatus 10 will cease operation to allow the deck to be relevelled. In use, the jack lift cylinders 36 are extended so that the deck 32 is at least the height of the well 20. The apparatus 10 is then lifted over the well 20, for example by a crane or forklift. The jack lift cylinders 36 are then adjusted until the deck 32 is substantially level (i.e. horizontal). A nut (not shown) is then positioned on the threaded support 38 in abutment with the sleeve 40 to prevent the deck 32 from sinking or losing level, in the event of hydraulic failure. So as to provide stability, the legs 34 are positioned around the well 20. There may be any number of legs 34 as appropriate. However, when lifting of the apparatus 10 into position over a well 20, or when removing the apparatus 10 from the well 20, four legs 34 may provide greater balance than an uneven number of legs.

Figure 5A:
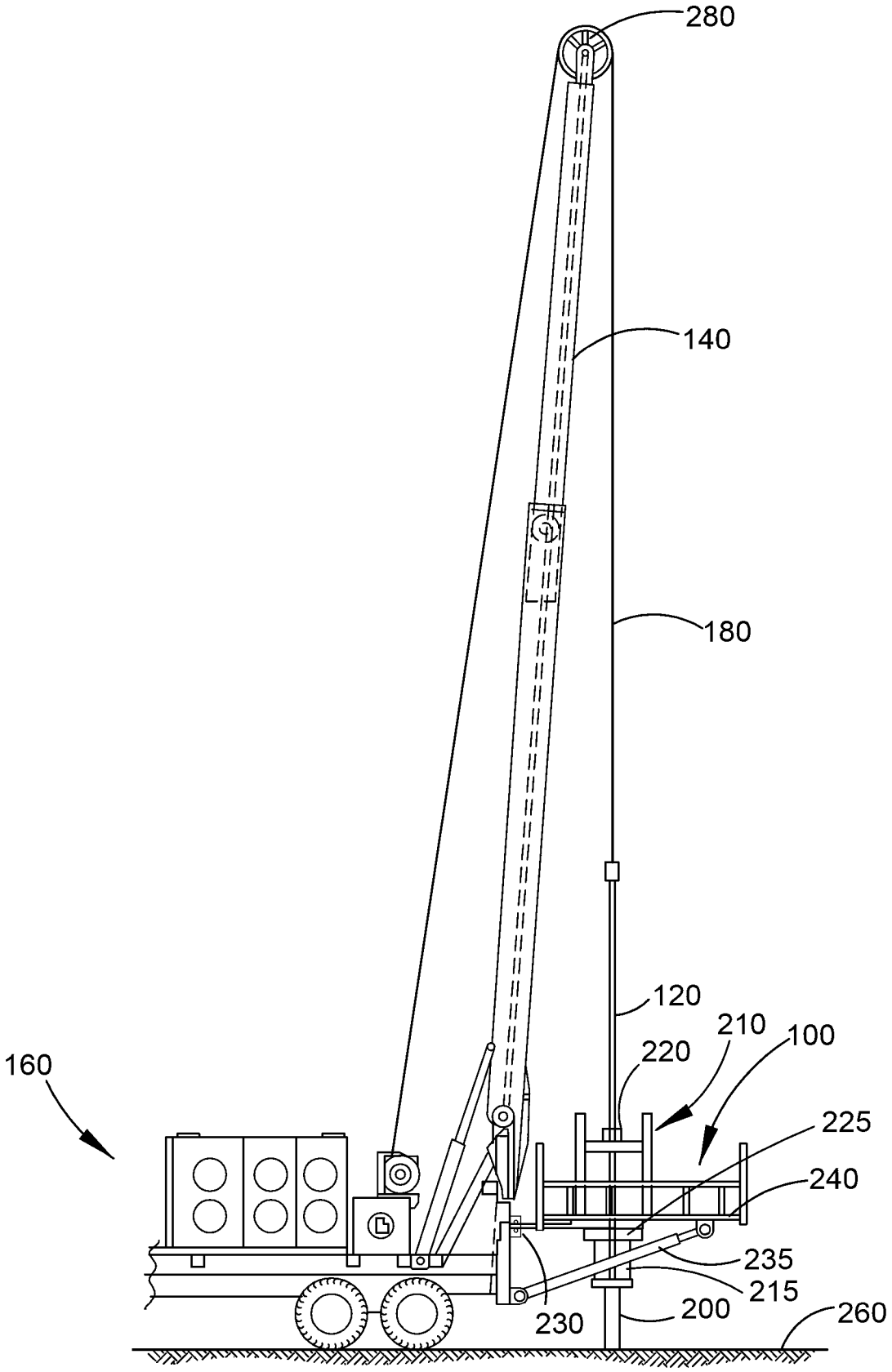
Figure 6:
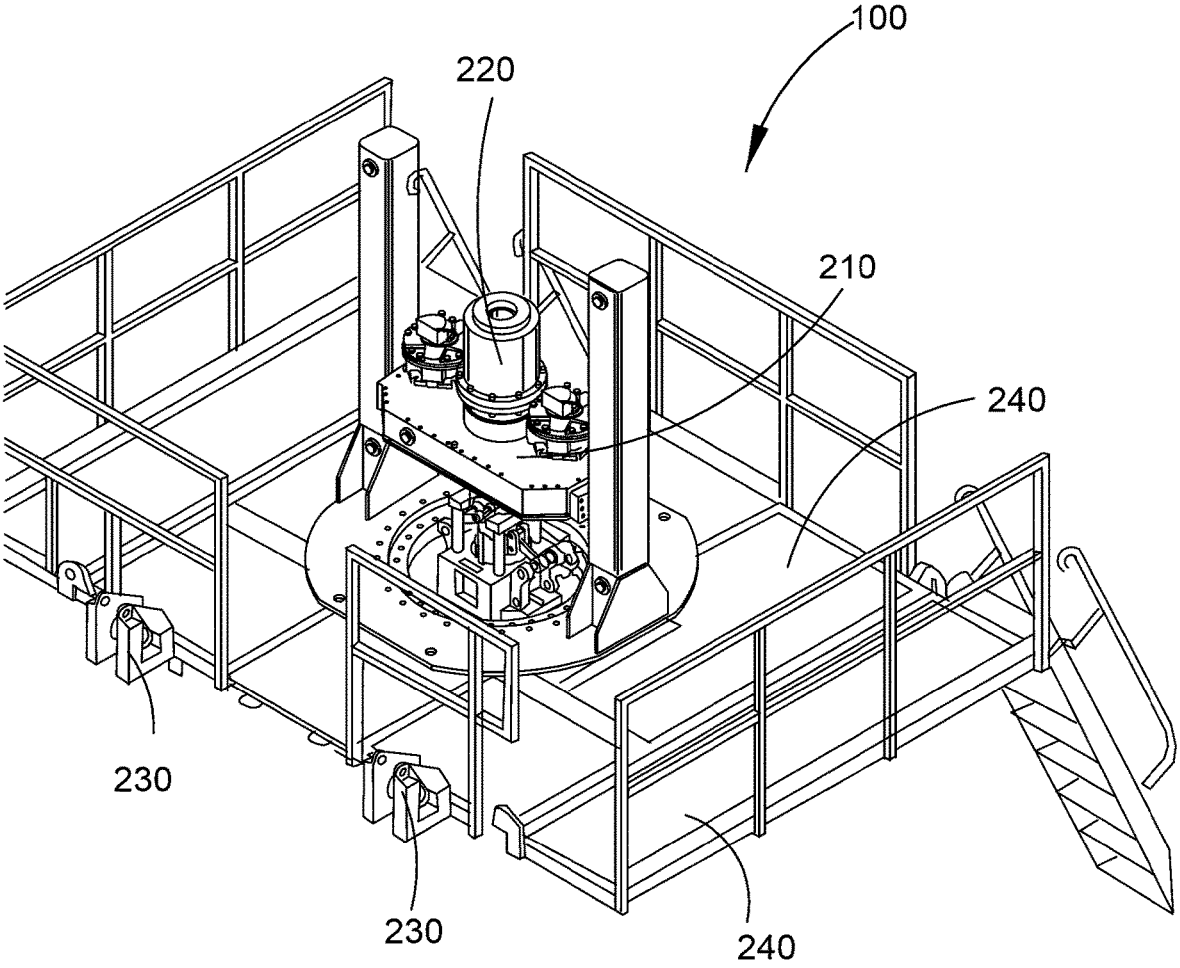
FIG. 6 is a perspective view of the apparatus of FIG. 5. The rig is not shown for clarity.
Figure 7:
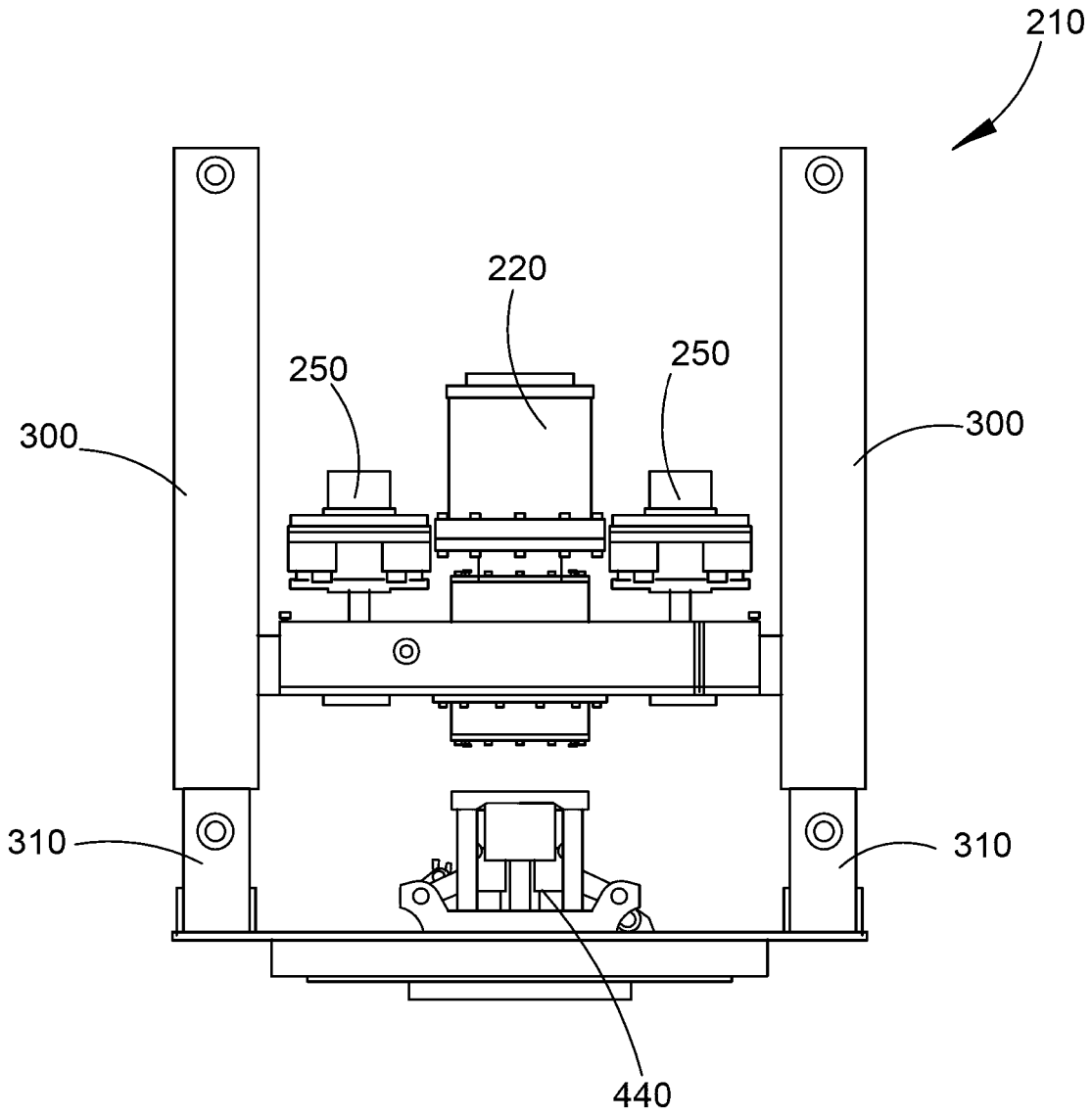
FIGS. 7 to 9 are perspective views of a part of the apparatus shown in FIG. 6.

As can be seen in FIG. 5, where the platform 240 is supported on the rear of rig 160, there is only required one pair of legs 340. The legs may be extensible so as to allow the platform to be substantially horizontal as it extends from the rear of the rig. As can be seen in FIG. 5A, there may be no legs remote from the rig. The platform 240 can be cantilevered and movable using hydraulic arm 235 and the platform 240 can then be lowered over the BOP 215. In this embodiment, the rotation member 210 is mounted by bolting it to the stuffing box which is associated with the BOP. A top view of the rotation member 210 in position is shown in FIG. 7. It should be understood that platform 240 is shown for illustration purposes only and in use, the platform may actually be U-shaped to allow access to the rotation member 210. Also there are likely to be substantially bolts in the holes in the base plate of the drill module which are how it is attached to the components of the well which cannot be seen because they are obscured from view.

Figure 8:
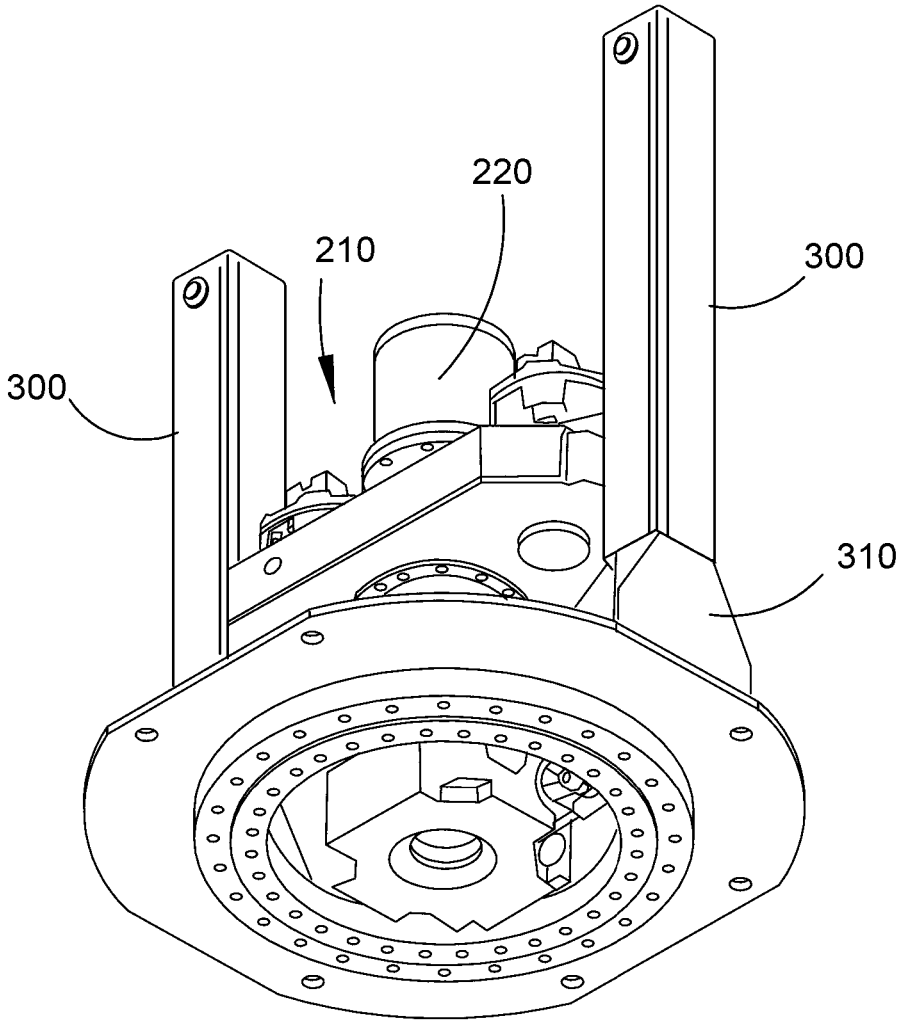
Figure 9:
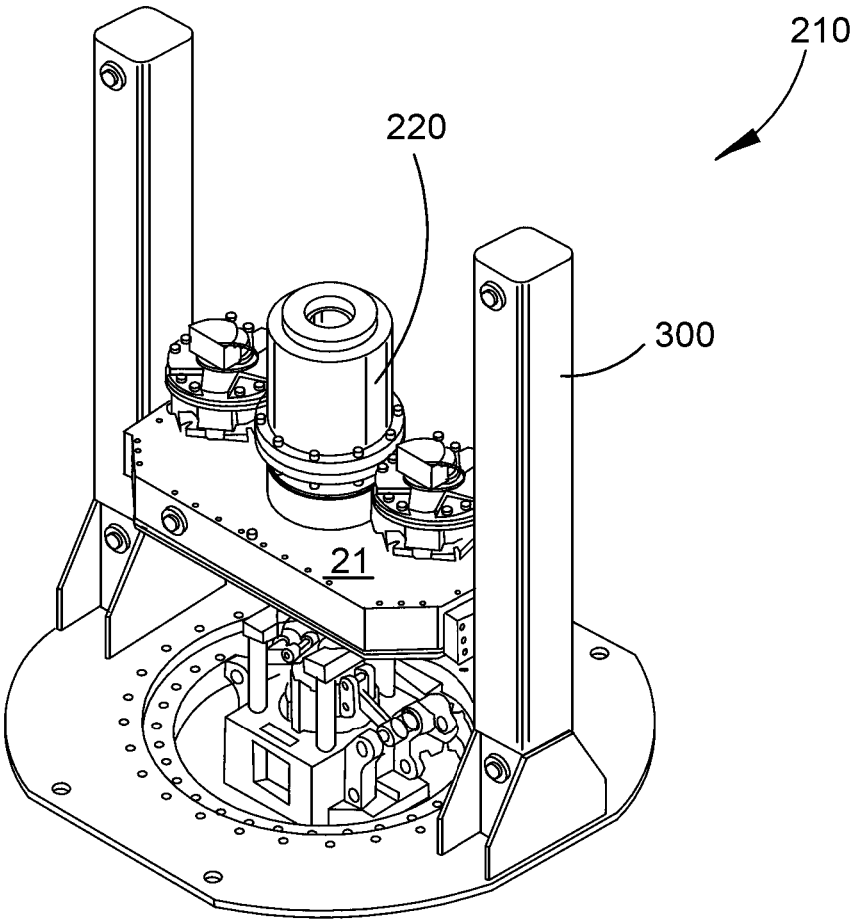

FIG. 8 is a cross-sectional side view of the rotation member 210 of FIG. 7. The hydraulic motors 250 operate to spin the bull gear (not shown) which is disposed in the component immediately beneath them (shown as a rectangle in cross section). The chuck 220 is thus rotated by the motors 250. FIGS. 8 and 9 are perspective top and bottom views for the sake of completion in viewing componentry.

In simplified version, a method in accordance with the present teachings, for inserting a rod 12 or 120 into a well 20 or 200, may include:

a. positioning a rig 16 or 160 in the vicinity of the well 20 or 200;
b. positioning the apparatus 10 or 100 over the well 20 or 200; and
c. lowering a rod 12 or 120 towards the well 20 or 200 using the rig 16 of 160, while concurrently rotating the rod 12 or 120 using the chuck drive 22 or 220.

In one embodiment, the step of positioning the apparatus over the well comprises mounting a rotation member to the well.

In more detail, a typical operation using the apparatus 10 of the present disclosure, a flushby rig 16 is setup next to a well 20. The flushby rig 16 flushes the well until it is determined that intervention is required. The mast 14 of the flushby rig 16 is then rotated away from the well 20 to provide clearance for positioning the apparatus 10 over the well 20. Is some cases, the mast 14 may be able to remain in position over the well 20 during positioning of the apparatus.

The rotation member can then be mounted to the well optionally by attaching it to the stuffing box. The attachment may be by bolting it to the stuffing box. In some embodiments, the apparatus is conveyed on site (e.g. by truck) to the vicinity of the well 20. During conveying, the platform of the apparatus will typically be 'in gauge'—in other words, the legs 34 of the platform will have been extended to a height such that the deck 32 will be higher than the well 20 when the apparatus 10 is positioned over the well 20. In some instances, the deck 32 may be substantially U-shaped, so that the well 20 or wellhead is received between the arms of the 'U'. Once the rotation member has been mounted, the deck 32 can be lowered around it. Providing a U-shaped deck 32 avoids the need to lift the deck 32 over the well 20. However, for intervention operations requiring higher loads on the winch 46 of the rig 16, the U-shape may compromise the strength of the apparatus 10. While strong gauge steels and other materials may be used to strengthen the apparatus 10 to afford use of a U-shaped deck 32 in all cases, the apparatus 10 should be capable of transportation down a roadway and within the confines of the road. So lower weight and smaller dimensions are desirable.

A crane or forklift can be used to lift the apparatus 10 into position on the ground, over the well 20. The distance from the front of the platform 24 to the centreline of the chuck drive 22 is 1000 mm, and the distance from safety rails located around the sides and rear of the deck 32 to the centreline of the chuck drive 22 is 1800 mm (i.e. overall length 2800 mm and overall width 3600 mm). The smaller 1000 mm dimension to the front of the platform 24 ensures the platform 24 falls short of the rearmost point of the rig 16. Often, a rig will provide a raised working platform at the rear. So the rearmost point of a rig in that case will be the rearmost point of the raised working platform.

Once positioned over the well 20, the apparatus 10 is hydraulically and electrically connected to the rig 16. This provides hydraulic and electric power to the apparatus 10 to facilitate, inter alia, adjustment of the legs 34. The controls of the rig 16 can be used to control the functions of the apparatus 10.

Once control of the hydraulics and electrics has been established, the heights of the legs 34 can be adjusted until the deck 32 is level. Once level, if the platform is structurally independent of the rig, two rams 45 are extended from the apparatus 10 to the rig 16. Each ram 45 is configured to engage the rig 16 thereby to fix the apparatus 10 to the rig 16. The rams 45 can prevent rotation of the apparatus 10 in the event that the rods 12 catch in the well and resist rotation of the chuck drive 22. If the mast 14 has been rotated away from the well 20 to facilitate positioning of the apparatus 10 over the well 20, the mast 14 can now be rotated back into position above the well 20.

Once level, one or more catwalks (not shown) are attached to sides of the apparatus 10 from which rods 12 can be drawn. Depending on the configuration of the well 20 and surrounds, a catwalk may be position on both sides of the decks 32 (e.g. the sides of the deck 32 extending towards and away from the rig 16), or alternatively a catwalk may be positioned at the rear of the deck 32.

Access ladders 50 are also provided optionally on the front side and rear side of the platform 24. The ladders 50 may be retractable for transporting the platform 24, or may be fixed in position at all times. If the platform is attached to the rig, the ladder is best located at the rear as shown in FIG. 5.

Once the apparatus 10 is set up, the hook of the rig 16, which is attached to the winch or drawworks 46 of the rig 16, is used to collect rods 12 from the catwalks and position the rods 12 in the chuck drive 22. When rods 12 extend through the apparatus 10 as shown in FIG. 1, the rods 12 can be held in position by a foot clamp 44 (see FIG. 4). Foot clamps, such as foot clamp 44, will be known to the skilled person and need not be described in detail herein.

For receiving a rod 12, the chuck drive 22 will typically be at the top of its stroke—in other words, the chuck drive 22 will be at its highest position on the tracks 30. A rod 12 is inserted into the chuck drive 22 from above, the chuck drive clamps onto the rod 12 and the rod descends, under the weight of the rod string, supported from above by the rig 16 and under rotation imparted by the chuck drive 22. The lift cylinders in the tracks 30 of the chuck drive 22 may control the descent of the rod 12 so that it does not drop. The full length of the stroke of the chuck drive 22 from the top of the stroke to the bottom—in other words, the position of the chuck drive 22 furthest from the well 20 to the position of the chuck drive 22 closest to the well 20—may be any desired length but will generally be selected to be an amount by which the length of the rod 12 is divisible. For example, the stroke of the chuck drive 22 is 1500 mm where the length of the rods 12 is 9000 mm. Thus four strokes of the chuck drive 22 are equivalent to the length of one rod 12.

Between successive strokes of the chuck drive 22, and while attaching further rods 12 or removing a rod 12, the rod 12 is held in position by foot clamp 44 and the feed of the rod 12 ceases. Therefore, the rods 12 are at all times attached to the platform. This provides a substantial safety benefit. If a rod 12 begins to be rejected by the well pressure, it will either be restrained in position by the foot clamp 44 or be held in the chuck drive 22. When clamped in the foot clamp 44, the rods will need to lift the entire weight of the apparatus 10—which may be 5t, 6t or more—before being able to eject from the well 20. When held in the chuck drive 22, the rods 12 may drive the chuck drive 22 to the top of its stroke but once in that position, the rods 12 will again need to lift the entire weight of the apparatus 10 before being able to eject from the well 20.

The winch 46 of the rig 16 may be advantageously provided with two-speed settings. The first, high-speed, setting is used during general lifting and drilling of the rods 12. Under this setting, called a 'fine feed', the rate of lowering of the tube or rod 12 is controlled. Since the rods 12 generally descend under the weight of the string of rods 12, there is generally a large downward pressure applied by the rods 12 to the chuck drive 22 or to the winch 46. When that downward pressure reduces to lower than a predetermined pressure, it indicates that that hard rock or some other source of backpressure has been encountered. In this circumstance, the winch 46 automatically retracts the rod 12 so that the chuck drive 22 travels at least part way to the top of its stroke. The winch 46 then uses a second, low-speed or 'weight-controlled feed', setting in which the rods 12 is inserted at a controlled, lower speed into the well 20. The term 'weight-controlled' is intended to encompass the use of weight as a trigger to moving to the slower feed rate, and also to encompass the use of the weight (i.e. a measurement of downward pressure of the rod or tube) to variably control a feed rate of the rod 12.

The 'predetermined pressure' may be set and measured using an existing 'load on hook' sensor of the rig 16. Using a flushby rig 16, the low-speed setting (i.e. weight-controlled feed rate) can be governed using the winch pumps. The winch pumps will stroke on and provide sufficient oil flow to hold back the weight on the hook of the rig 16. The winch brakes are then released, with no load movement due pressure applied by the oil flowing through the winch pumps, and the rods 12 can be lowered at a desired rate.

Where the winch 46 is configured to automatically switch to the low-speed, or weight-controlled feed, setting then predetermined pressure may be fixed and the rate of weight-controlled feed may similarly be fixed. In particular, the predetermined pressure may depend on the drilling or hole cleaning requirements of the work being performed. Where an operator is controlling the rate of weight-controlled feed, the operator may control the fluid flow through the winch pumps and thereby select the rate of weight-controlled feed of the rods 12. Alternatively, the apparatus 10 or rig 16 may automatically adjust the feed rate to maintain a particular downward pressure measurement and thereby control the rate of feed (i.e. the feed rate is controlled by the 'weight').

A similar retraction and fine feed process may be used where the rods 12 begin to grab in the well 20, or where the density of the fluid returning from the well 20 increases to a degree that may damage the pumps. In the latter case, the rods are fed at fine feed rate (i.e. more slowly) so that comparatively more fluid is pumped into the well 20 as the rod 12 advances. In some circumstances, when the density of the fluid pumped from the well increases to a point at which the pumps may become damaged, the fine feed may be used without first withdrawing the rods 12—in other words, the rod does not stop advancing, but simply advances at a slower rate while the pumps continue to pump at their previous rate.

For lighter strings of rods 12, the lift cylinders mounted in the tracks 30 may be controlled to provide fine feed capabilities.

Once the intervention has been completed, the catwalks are removed from the platform 34, the hydraulics and electrics are disconnected form the rig 16 and the apparatus 10 is lifted off the well 20 and onto a truck for removal. In another embodiment, the platform is moved to the inoperable position by folding it towards the body of the rig.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention. It is to be understood that, if any prior art publication is referred to herein, such reference does not constitute an admission that the publication forms a part of the common general knowledge in the art, in Australia or any other country.

The invention claimed is:

1. A system comprising a mobile drill rig and an apparatus for rotating a tube or rod, the tube or rod being supported from a mast of the rig and for insertion into a well, the apparatus including a rotation member for rotating the tube or rod and a support member comprising a platform for supporting the rotation member over the well, wherein the rotation member is mounted on the well to carry a weight of the rotation member such that in use the rotation member is supported by the well, the tube or rod is fed into the rotation member, from above the rotation member, and into the well, and the tube or rod inserted into the well is retained within the well by the rotation member and a weight of the apparatus.

2. The system according to claim 1, wherein the platform is an access platform configured for providing access to the rotation member.

3. The system according to claim 2, wherein the access platform is attached to the rig.

4. The system according to claim 2, wherein, when in use, the access platform is supported substantially horizontally by a plurality of legs.

5. The system according to claim 1, wherein at least the rotation member is structurally independent from the rig.

6. The system according to claim 1, wherein the rotation member provides a fine feed function and a weight-controlled feed function for lowering the tube or rod at a faster and a slower speed respectively.

7. The system according to claim 6, wherein, when a downward force of the tube or rod, as measured by the apparatus or rig, is lower than a predetermined threshold, the rotation member rises to at least partially withdraw the tube or rod from the well, and the weight-controlled feed function is used to lower the tube or rod at a slower speed.

8. The system according to claim 1, wherein the rotation member has a stroke over which, in use, the rotation member advances downwardly with the tube or rod towards the well before resetting back to a top of the stroke.

9. The system according to claim 1, wherein the tube or rod is part of a tube or rod string, the apparatus further comprising a foot clamp provided on a support associated with the apparatus, the foot clamp for retaining the tube or rod string while a further tube or rod is attached thereto.

10. The system according to claim 1, wherein the apparatus is hydraulically and/or electronically connectable to the rig.

11. The system of claim 1, wherein, the platform is movably attached to the rig for providing access to the rotation member over the well.

12. A method for inserting a tube or rod into a well, comprising:

a. positioning a rig in the vicinity of the well;

b. mounting the rotation member according to claim 1 on the well such that it is supported by the well;

c. lowering a tube or rod towards the well using the rig, and concurrently rotating the tube or rod using the rotation member of the apparatus.

13. The method according to claim 12, wherein the method further comprises the step of providing an access platform for providing access to the rotation member mounted on the well.

14. The method according to claim 12, wherein the method further comprises:

d. lowering the tube or rod at a first speed through the rotation member using a winch of the rig;

e. measuring a 'weight on hook' of the winch;

f. at least partially retracting the tube or rod from the rotation member when the measured 'weight on hook' indicates that the tube or rod is exerting pressure on the well that exceeds a predetermined pressure; and g. lowering the tube or rod at a second speed lower than the first speed through the rotation member.

15. The method according to claim 14, wherein the measuring step is performed while at least the first lowering step d. is being performed.

16. A system comprising a mobile drill rig and an apparatus for rotating a tube or rod string, the tube or rod string comprising a plurality of tubes or rods attached to one another, the tube or rod string being supported from a mast of the rig and for insertion into a well, the apparatus including a rotation member for rotating the tube or rod string and a support member comprising a platform for supporting the rotation member over the well, wherein the rotation member is mounted on the well to carry a weight of the rotation member such that in use the rotation member is supported by the well, the tube or rod string is fed into the rotation member, from above the rotation member, and into the well, and the tube or rod string inserted into the well is retained within the well by the rotation member and a weight of the apparatus.

* * * * *